United States Patent [19]

Stein et al.

[11] 4,200,521

[45] Apr. 29, 1980

[54] CATALYTIC HYDROPROCESSING OF SOLVENT REFINED COAL TO PROVIDE A LIQUID AND A SOLID FUEL

[75] Inventors: Thomas R. Stein, Cherry Hill; Roland H. Heck, West Deptford; Michael J. Dabkowski, Mantua, all of N.J.

[73] Assignee: Electric Power Research Institute, Inc., Palo Alto, Calif.

[21] Appl. No.: 913,478

[22] Filed: Jun. 7, 1978

[30] Foreign Application Priority Data

Jul. 26, 1977 [GB] United Kingdom ..... 31308/77

[51] Int. Cl.[2] ..... C10G 23/02

[52] U.S. Cl. ..... 208/216 PP; 208/254 H

[58] Field of Search ..... 208/213, 216 PP, 8 LE, 208/254 H

[56] References Cited

U.S. PATENT DOCUMENTS

| | | | |
|---|---|---|---|
| 3,748,254 | 7/1973 | Gorin | 208/8 LE |
| 4,009,125 | 2/1977 | Geierhaas et al. | 208/216 PP |
| 4,014,821 | 3/1977 | Hamner | 208/216 PP |
| 4,048,060 | 9/1977 | Riley | 208/216 PP |
| 4,052,296 | 10/1977 | Montagna | 208/216 R |
| 4,069,139 | 1/1978 | Riley et al. | 208/216 PP |

*Primary Examiner*—George Crasanakis

*Attorney, Agent, or Firm*—Scully, Scott, Murphy & Presser

[57] ABSTRACT

In the hydroprocessing of blends of solvent refined coal and recycle solvent, small pore hydrotreating catalysts cause separation of a solid phase from treating blends containing high concentration of solvent refined coal.

4 Claims, No Drawings

CATALYTIC HYDROPROCESSING OF SOLVENT REFINED COAL TO PROVIDE A LIQUID AND A SOLID FUEL

FIELD OF THE INVENTION

The invention relates to upgrading of solvent refined coal (SRC) obtained from dissolution of coal in a solvent derived in the process and recycled after separation from the product SRC, generally called "recycle solvent". The product SRC contains substantial amounts of sulfur and nitrogen (as well as oxygen) which must be reduced before use as fuels in order to meet emission standards for boilers, turbines and other liquid fueled equipment.

In attempting to apply the vast store of technology on similar treatment of petroleum fractions, it is found that the very different nature of SRC poses new problems to such an extent that different considerations apply to removal of sulfur, nitrogen and like undesirable components from SRC. Specifically, in reducing these undesirable components of SRC by hydroprocessing, it is found desirable to blend the SRC with recycle solvent. The amount of recycle solvent available is limited. Certain commercially available hydrotreating catalysts are found to result in separation of liquid and solid phases of the hydrotreated product when the charge contains a high concentration of SRC, resulting in plugging of the hydroprocessing reactor.

It is an important objective of the invention to provide a combination of catalyst characteristics and concentration of the SRC/recycle solvent blend which will yield a homogeneous liquid product from hydrotreating without undue demand for recycle solvent in the charge blend.

BACKGROUND OF THE INVENTION

The present emphasis on the conversion of coal to substitute solid and liquid fuels has led to several alternative processes which are now being considered. The end use of the resultant converted coal will primarily determine the degree of conversion that must be accomplished and the quality of the desired product. The optimal use of the coal will depend on the specific application.

Among the many processes presently being considered is the solvent refining of coal (SRC) in which coal is treated at an elevated temperature in the presence of a hydrogen-donor solvent and hydrogen gas in order to remove the mineral matter, lower the sulfur content of the coal, and to convert it into a low melting solid which can be solubilized in simple organic solvents. This SRC can also be upgraded through catalytic hydrogenation to produce a liquid of higher quality. These two processes are of concern to the present invention.

Little is known at present as to the exact mechanisms by which the coal is transformed into soluble form, or of the detailed chemical structure of the soluble product or even the parent coal. It is known that many coals are easily solubilized and for others solubilization is more difficult. Some correlations have been made between the rank of the coal and ease of solubilization and product yield. A somewhat better correlation has been found with the petrography of the coal. Little is known about the relationships to product quality.

The initially dissolved coal (SRC) may have utility as a substitute clean fuel or boiler fuel; however, for substitute fuels of higher quality, specifications on viscosity, melting point, ash, hydrogen, and sulfur contents are much more stringent. Attempts to meet these specifications by operating the SRC process more severely have met with many difficulties such as low liquid yields, high hydrogen consumption, difficulty of separating unreacted residue, and excessive char formation, which often completely plugs process transfer lines and reactors.

Alternative methods of improving specifications, through catalytic hydrogenation are also difficult. The problems which arise are threefold: (1) SRC components are susceptible to further condensation and may deposit as coke on catalysts used for their conversion, (2) they can also foul the catalysts by physical blockage as their size approaches the pore size of conventional catalysts and (3) they may contain metal contaminants, and their highly polar nature (particularly nitrogenous and sulfur compounds) can lead to selective chemisorption, and thus poison the catalysts.

The precise chemical nature of the SRC is still unknown; generally its composition is discussed in terms of solubility. Several classifications are commonly used. These include oils which are hexane or pentane soluble, asphaltenes which are benzene soluble, and pyridine soluble-benzene insoluble materials. Of these the asphaltenes and pyridine soluble-benzene insoluble materials are believed to be responsible for high viscosity, solvent incompatability, and processing difficulties. Little is known about the pyridine soluble-benzene insoluble materials. These have been referred to as "pre-asphaltenes" which implies that asphaltenes are derived from them; however, this has yet to be established.

More information is available on the nature of asphaltenes. It is common experience that coal liquids contain large quantities of materials known as asphaltenes. In fact, it has even been suggested that the formation of asphaltenes is a necessary step in the liquefaction of coal.

The term asphaltene is a rather nebulous and all-inclusive classification of organic materials for which a detailed chemical and physical identification is quite difficult, and has not yet been accomplished.

This classification generally refers to high molecular weight compounds, boiling above 650° F., which are soluble in benzene and insoluble in a light paraffinic hydrocarbon (e.g., pentane). Usually no distinction is made regarding polarity, as the term has been used customarily in the characterization of heavy petroleum fractions (resids, etc.) where the amount of highly polar materials is small. However, in coal liquids this may not necessarily be the case due to the high degree of functionality of coal itself. Thus, coal liquids of low molecular weight may still be "asphaltenes." There is considerable variation in the molecular weight of solubilized coals which arises from differences in the parent coals or different solvent or solvent-reactant systems at the same temperature of reaction. This could well be related to colloidal properties of coal liquids. It is well documented that asphaltenes found in heavy petroleum fractions are colloidal in nature.

Some comments on the chemical nature of coal asphaltenes have recently been made. Asphaltenes from Synthoil Process liquids were separated into a basic fraction (containing oxygen only as ether or ring oxygen and basic nitrogen as in pyridine) and an acidic fraction (containing phenolic OH and nitrogen as in pyrrole). The two fractions were found to have very different properties. The basis fraction could be hydrotreated only with difficulty, while the acid fraction underwent facile hydrotreating. This is consistent with reported data on the influence of nitrogen heterocycles on conventional hydroprocessing.

Based on these results an acid-base pair structure for asphaltenes were proposed and this structure was extrapolated to that of coal itself. This structure is quite different from the more amphoteric nature of coal which has been proposed previously.

Mechanisms have been proposed for the noncatalyzed formation of asphaltenes from coal. In this work it was concluded that asphaltenes were a *necessary* product of coal liquefaction and that oils were derived from asphaltenes. The more polar pyridine soluble materials where not investigated and were assumed to be equivalent to unreacted coal. The maximum yield of asphaltenes were found, however, to be a function of the conditions of coal conversion; hydrogen donor solvents greatly reduced the propensity for formation of asphaltenes as low conversion. In addition, it was not determined whether the asphaltene fractions resulting from different conditions were of the same chemical and/or physical nature. Thus, asphaltenes may be inherent constituents of coal products or they could well be the result of either thermal or catalytic transformations of more polar materials.

In considering what may be involved in the formation of asphaltenes during coal solubilization or conversion, it may be instructive to consider what is known of coal structure. Coal is a rather complicated network of polymeric organic species the bulk of which is porous in the natural form; the pore system varies from coal to coal. Depending upon the specific nature of the porous structure of each coal, its chemical constituents, and the reaction conditions, the rate of diffusion and mass transport of organic molecules through the pores could have a strong effect on the rates of dissolution, hydrogen transfer, and hydrogenation and hydrocracking reactions, and thus on the ultimate yield of soluble product.

As the rank of coal becomes higher, an increasing number of colloidal size aggregates (20–50Å) can be observed by X-ray scattering and diffraction.

If, in the early stages of the dissolution of coal these colloidal aggregates dissociate to some degree and go into solution, the molecular weight of the lowest unit appears to be consistent with the lowest molecular weight observed in solubilized coals (~500 MW). This comparison may be coincidental, however. Unfortunately, in order to dissolve coal it is generally found that temperatures in excess of 300° C. are necessary. It is also known that coal begins to pyrolize and evolve volatile matter at temperatures as low as 250° C. (depending on rank), and by 350° C. considerable material has evolved. This strongly suggests that extensive internal rearrangement of the coal occurs during the dissolution process. Rearrangement can include hydrogen migration to produce highly condensed aromatic rings as well as further association of small colloidal aggregates or condensation of reactive species Major physical changes in the pore system of the solid coal have also been reported.

This rearrangement could possibly be responsible for some of the very high molecular weights (~3000 MW) observed with some solvents. No detailed relationships of solvent type and/or reaction condition to the molecular weight distribution of solubilized coal has yet been established. Similarly, the possibility of reversible molecular weight changes, due to recondensation causing increased molecular weights at various temperatures, has not been investigated thoroughly.

An alternative route to high molecular weight is through the catalytic influence of inorganic coal minerals which are present in the processing of coal. It is known that some coals are more reactive than others, producing higher yields of liquid products at shorter residence times. It is believed that this is due to the fact that the initial coal products are reactive and condense to char unless proper reaction conditions are established. This further condensation could well be a catalytic phenomenon induced by intrinsic coal minerals.

Another more subtle consequence of certain inorganic constituents is their influence on the physical properties of pyrolytic coal chars, and thus on the diffusional properties imposed on reactive intermediates. The volume of char has been observed to vary by a factor of four or more, with little change in weight, by varying the type of inorganic contaminants in a given bituminous coking coal. The pore system of the resultant chars must be vastly different and changes of this type magnitude in the physical structure of the coal or char could greatly influence mass transport of intermediates produced within the pore system. Mass transfer limitation during the pyrolysis and hydrogasification of some coals at high temperatures has recently been established. This study showed that for some coals, reactive primary products are formed which can recombine to produce char if the conditions are not properly adjusted. The criticality was found to be the rate of diffusion of the reactive species out of the coal relative to its rate of conversion to char.

At lower temperatures, the rates of reaction are, of course, slower and thus less susceptible to mass transport limitations. However, the imposition of a liquid phase, commonly used in liquefaction processes, may greatly enhance diffusional restrictions. Recent model studies conducted in aqueous systems, have shown that restriction of diffusion through porous structures with pore radii ranging from 45Å to 300Å for even relatively small solute molecules is very significant.

At the present stage of the art, the accumulated information is largely empirical, with little basis for sound extrapolation of predict detailed nature of solvent and processing conditions for optimum yield and quality of solvent refined coal. It is recognized that the poorly understood asphaltenes are probable sources of many of the problems encountered, e.g. formation of char at processing conditions conducive to efficient separation of mineral matter (ash) and sulfur from desired product at high yield.

In the process of converting coal to a low sulfur, low melting solid by use of recycled product fractions as solvent, several reaction steps occur. Generally coal is admixed with a suitable solvent recycle stream and hydrogen and the slurry is passed through a preheater to raise the reactants to a desired reaction temperature. For bituminous coal, the coal is substantially dissolved by the time it exits the preheater. Sub-bituminous coals can be dissolved but care must be exercised not to raise the temperature too high and thus promote charring.

The products exiting from the preheater are then transferred to a larger backmixed reactor where further conversion takes place to lower the heteroatom content of the dissolved coal to specification sulfur content and melting point. The geometry of this reactor is such that the linear flow rate through it is not sufficient to discharge a substantial quantity of particulate matter of a desired size. Thus the reactor volume becomes filled (at steady state) up to about 40 vol % by solids which are produced from the coal. These solids have been shown to be catalytic for the removal of heteroatoms and the introduction of hydrogen into the coal products and solvent. The products exiting the reactor are initially separated by flash distillation, which depressurizes the stream and removes gases and light organic liquids. The products are further separated (filtration, centrifugation, solvent precipitation, etc.) and the filtrate is distilled to recover solvent range material (for recycle) and the final product SRC.

The solvent refined coal recovered from such processing is a solid at ambient temperature and is constituted by material boiling above about 650° F. Recycle solvent boiling in the range of 260°-650° F. is the balance of the reactor effluent after removal of gases and light organic liquid boiling below about 260° F. The recycle solvent fraction is produced in amounts of about 10-15% by weight based on the coal charged to the solvent process. This material differs in nature of components from petroleum fractions but is generally miscible with petroleum cuts. The solid SRC is produced in yields between about 50 and 65 weight percent based on charge and exhibits great differences in composition from the conventional petroleum fuels. It is, of course, miscible with recycle solvent, but is highly incompatible with petroleum fractions of like boiling range.

Whatever the chemical nature and reactivity of the large number of chemical species in SRC and in recycle solvent and whatever physical form they may take, the aggregate liquid fuel is of a different nature than the well-known petroleum fractions which have long served to satisfy the demand for liquid fuels, both distillates and resids, typified by No. 2 and No. 6 fuel oils, respectively. For example, the so-called "asphaltenes", generally defined as the compounds soluble in benzene and insoluble in paraffins are of relatively low molecular weight in SRC ranging from below 1000 up to about 1300. The asphaltene content of petroleum fractions is constituted by compounds of several thousand molecular weight, on the order of 10,000.

In comparison with petroleum fuels and residua, coal liquids generally exhibit slightly higher carbon content, but significantly lower hydrogen content. These data suggest both a higher degree of aromaticity and a more highly condensed ring structure for coal liquids.

A more striking difference between the coal liquids and petroleum fuels is the heteroatom content. Nitrogen and oxygen in coal liquids are much higher than in petroleum, but sulfur is somewhat lower. Furthermore, 40-70 wt % of the nitrogen in coal liquids is basic in character compared to 25-30 wt % for typical petroleum stocks.

The differences are strikingly illustrated by the data given by Callen, Simpson, Bendoraitis and Voltz, "Upgrading Coal Liquids to Gas Turbine Fuels. 1. Analytical Characterization of Coal Liquids", I&EC Product Research and Development, 16, 222 (1976). Those authors examined coal liquids by Gradient Elution Chromatography (GEC) and showed the striking difference in relative quantities of GEC fractions from petroleum fractions as compared with coal liquids, reflecting major differences in polarity and other aspects of the molecules constituting these fractions. The Callen et al. article is hereby incorporated by reference, as are:

Cabal et al. "Upgrading Coal Liquids to Gas Turbine Fuels. 2 Compatibility of Coal Liquids with Petroleum Fuels" I&EC Product Research and Development, 16, 58-61 (March, 1977).

Stein et al. "Upgrading Coal Liquids to Gas Turbine Fuels. 3. Exploratory Process Studies", 16, 61-68 (March 1977)

It is to be expected that coal liquids may be upgraded by techniques in advanced stages of development for hydrotreating petroleum fractions to remove sulfur, nitrogen, oxygen and metals. It is further to be expected that, as hydrotreating of coal liquids is carried forward to the point of approaching petroleum fractions in compositions, the product will more closely resemble petroleum and be constituted by mutually miscible components.

SUMMARY OF THE INVENTION

The invention provides techniques for controlling nature of the product from hydroprocessing or SRC/recycle solvent blends containing high concentrations of SRC, greater than 50%. As will appear below, hydroprocessing of blends in which the recycle solvent predominates proceed smoothly to yield a liquid product of reduced sulfur, nitrogen and oxygen content and enhanced hydrogen to carbon ratio. Similar effective processing of blends containing a major portion of SRC are achieved by employing a catalyst characterized by relatively large pores, that is, at least 50% of the total pore volume is provided by pores of at least 100 Å diameter as determined by mercury porosimetry. When a catalyst of smaller pore size is used for treating blends containing a major portion of SRC, separation of a solid phase is observed. The value identifying blends which require large pore hydroprocessing catalyst for production of a one-phase liquid product may be stated in terms of the gradient elution chromatography (GEC) fractions defined in the Callen et al. article cited above. If the sum of polar and non-eluted asphaltenes appearing as Callen et al. GEC fractions 8 to 13, inclusive, exceeds 30 weight percent of the total, hydroprocessing yields a single phase liquid product from treating over a catalyst having 50% or more of its pore volume as pores of at least 100 Å diameter. Two phase products may be expected from hydroprocessing blends of more than 30% polar and non-eluted asphaltenes over catalysts of lower average pore diameter.

Accordingly, it is an important object of the invention to provide control methods in hydroprocessing SRC/recycle solvents blends of high SRC content or high total polar and non-eluted asphaltenes. Such processing may be manipulated to provide a single phase liquid product or a two phase product containing separable liquid and solid fuels by appropriate selection of catalyst.

DESCRIPTION OF SPECIFIC EMBODIMENTS

The invention contemplates hydroprocessing of blends of SRC with recycle solvent applying techniques developed in hydroprocessing of petroleum fractions modified to fit the peculiar characteristics of blends containing large amounts of SRC.

The conditions of treatment are generally similar to those utilized in hydrotreating petroleum fuels, distillates and residuals, for desulfurization and denitrogenation. The catalyst may be any of the commercially available hydrotreating catalysts which are generally cobalt/molybdenum or nickel/molybdenum on a porous base of alumina which may contain up to about 5% silica.

The catalyst will have pores within a range characteristic of the particular catalyst.

The parameters of processing severity in hydro-processing are well understood from developments in hydro-treating petroleum fractions and their interdependence is well recognized. Esentially, the severity is a function of temperature, pressure, hydrogen to hydrocarbon ratio (H/HC) usually stated in standard cubic feet of hydrogen per barrel of feed (SCF/B) or in moles and hourly spaced velocity in units of charge per unit of catalyst per hour; by weight (WHSV) or volume (LHSV). Severity may be increased by increased temperature, pressure or H/HC or by decreased space velocity (increased catalyst/oil ratio). The variables are interdependent within limits. For example, constant severity at reduced temperature may be attained by decrease of space velocity. For purposes of the present invention, temperatures will range from about 650° F. to 850° F. at pressures upwards of about 500 psig and space velocities of 0.1 to 3 LHSV. Hydrogen is supplied at a rate of several thousand SCF/B.

Having regard to the fact that solvent refining of coal produces an amount of SRC greater than the quantity of recycle solvent, it is appropriate to use minimal amounts of recycle solvent in preparing blends for hydroprocessing. We have observed criticality of (1) SRc concentration and (2) catalyst pore size in effecting the upgrading of blends of SRC/recycle solvent derived from coal. A low concentration SRC blend was successfully hydroprocessed over a small pore CoMo catalyst producing a single phase liquid product. An attempt to upgrade a higher concentration SRC blend over a small pore NiMo catalyst resulted in a two phase solid/liquid product; and a single liquid phase when hydroprocessed over a large pore NiMo catalyst.

A series of fixed-bed hydroprocessing studies has been made upgrading blends of solvent refined coal (SRC) in recycle solvent over several commercial hydrotreating catalysts. Table 1 lists the three catalysts—small pore (70–80 Å) CoMo and NiMo and a large pore (170 Å) NiMo catalyst. All catalysts are 1/16" extrudates. The pore size distributions (determined by mercury porosimetry) are also listed showing most of the pores are in the 50–100 Å diameter range for the HDS-1441A and Ketjen 153S. The Harshaw 618X has most of its pores in the 100–200 Å diameter range.

Table 2 lists the properties of the two blends of SRC in recycle solvent. Blend A is approximately 40 wt % SRC and Blend B is approximately 60 wt % SRC. These blends were made by mixing Wilsonville SRC product (Burning Star Coal) with the recycle solvent at about 200° F. while stirring. Elemental analysis and Conradson Carbon Residue (CCR) are given in Table 2 for the SRC, and Blends A and B. The blends were charged to a fixed-bed hydroprocessing unit at 2000 psig hydrogen pressure, 600°–800° F., and liquid hourly space velocities of 0.1 to 1.0. The results of these runs are detailed below:

The lower concentration SRC Blend A (40%) was hydroprocessed over a small pore ($\bar{d}$=71 A) CoMo catalyst for ten days at 2000 psig hydrogen pressure, temperatures ranging from 624°–788° F., and 0.21 to 1.05 LHSV. Complete data from this run are listed in Table 3. The products were single phase liquid.

Table 1

Hydrotreating Catalyst Properties

| Catalyst Indentification | HDS-1441A | Ketjen 153S | Harshaw 618X |
|---|---|---|---|
| Metals | CoMo | NiMo | NiMo |
| Avg. Pore Diameter, Å | 71 | 81 | 171 |
| Surface Area, $m^2/g$ | 323 | 255 | 140 |
| Pore Volume Distribution, cc/g | | | |
| >50 Å | 0.114 | 0.041 | 0.040 |
| 50–100 Å | 0.441 | 0.426 | 0.062 |
| 100–200 Å | 0.005 | 0.032 | 0.461 |
| 200–300 Å | 0.000 | 0.006 | 0.024 |
| >300 Å | 0.010 | 0.015 | 0.013 |
| Total | 0.57 | 0.52 | 0.60 |

Table 2

Properties of Wilsonville Solvent Refined Coal (SRC) and Blends of Recycle Solvent/SRC

| Properties | SRC | Blend A | Blend B |
|---|---|---|---|
| Wt % SRC | 100 | 40 | 60 |
| Hydrogen, Wt % | 5.72 | 6.84 | 6.36 |
| Nitrogen, Wt % | 1.71 | 1.03 | 1.25 |
| Sulfur, Wt % | 0.57 | 0.41 | 0.47 |
| CCR, Wt % | 48 | 16.5 | 25.0 |

Table 3

Hydroprocessing Blend A Over HDS-1441A Catalyst

| Example No. | Charge | 1 | 2 | 3 | 4 | 5 | 6 | 7 | 8 | 9 | 10 |
|---|---|---|---|---|---|---|---|---|---|---|---|
| OPERATING CONDITIONS | | | | | | | | | | | |
| Temperature, °F. | — | 674 | 731 | 775 | 675 | 719 | 778 | 624 | 729 | 777 | 788 |
| Pressure, PSIG | — | 2000 | 2000 | 2000 | 2000 | 2000 | 2000 | 2000 | 2000 | 2000 | 2000 |
| LHSV | — | .96 | .98 | .97 | .47 | .40 | .40 | .24 | .21 | .22 | 1.05 |
| LIQUID PRODUCT PROPERTIES | | | | | | | | | | | |
| Api Gravity | −3.0 | 10.2 | 9.6 | 12.6 | 7.1 | 11.7 | 16.9 | 4.1 | 15.5 | 20.1 | 9.9 |
| Hydrogen, Wt % | 6.84 | 8.38 | 9.04 | 8.79 | 8.47 | 9.48 | 10.17 | 8.98 | 10.15 | 10.57 | 8.18 |
| Sulfur, Wt. % | .41 | .20 | .11 | .07 | .14 | .08 | .05 | .18 | .06 | .06 | .12 |
| Nitrogen, Wt. % | 1.03 | .75 | .58 | .63 | .76 | .42 | .16 | .92 | .22 | .10 | .54 |
| Oxygen, Wt. % | 3.91 | 1.80 | .70 | .50 | 1.50 | .60 | .20 | 2.20 | .20 | .20 | 1.80 |
| Aromatic Carbon, Pct. | 78 | — | — | — | — | — | — | 62 | 39 | 35 | — |
| CCR, Wt. % | 16.49 | 10.47 | 8.64 | 6.02 | 10.40 | 6.28 | 3.63 | 11.29 | 4.30 | 3.99 | 8.60 |
| KV at 100° F. | 129.00 | 19.17 | 9.28 | 4.96 | 16.05 | 17.05 | 3.33 | 28.10 | 4.28 | 2.72 | 6.06 |
| HETEROATOM REMOVAL, PCT. | | | | | | | | | | | |
| Sulfur | — | 52.8 | 73.3 | 84.3 | 66.8 | 81.3 | 87.3 | 56.1 | 85.1 | 87.1 | 74.6 |
| Oxygen | — | 54.8 | 82.8 | 87.7 | 62.5 | 85.1 | 95.1 | 43.7 | 95.0 | 95.1 | 55.6 |
| Nitrogen | — | 28.5 | 45.9 | 41.3 | 27.8 | 80.4 | 85.0 | 10.6 | 79.3 | 90.9 | 49.4 |
| HYDROGEN UTILIZATION SCF/BBL | | | | | | | | | | | |
| H2 Consumed by C1–C5 | — | 54 | 214 | 208 | 91 | 151 | 326 | 4 | 182 | 453 | 240 |
| H2 Consumed by C6+ | — | 1033 | 1388 | 1183 | 1043 | 1714 | 2117 | 1557 | 2173 | 2376 | 784 |
| H2 Consumed by S | — | 10 | 14 | 16 | 13 | 15 | 16 | 11 | 16 | 16 | 14 |
| H2 Consumed by N | — | 46 | 74 | 67 | 45 | 97 | 137 | 17 | 128 | 147 | 80 |
| H2 Consumed by O | — | 196 | 296 | 314 | 224 | 305 | 340 | 156 | 340 | 340 | 199 |

Table 3-continued

| Example No. | Charge | 1 | 2 | 3 | 4 | 5 | 6 | 7 | 8 | 9 | 10 |
|---|---|---|---|---|---|---|---|---|---|---|---|
| | Hydroprocessing Blend A Over HDS-1441A Catalyst | | | | | | | | | | |
| H2 Consumed Total | — | 1339 | 1986 | 1788 | 1415 | 2282 | 2937 | 1745 | 2839 | 3332 | 1316 |

In hydroprocessing the higher concentration SRC Blend B (60%) over a small pore ($\bar{d}$=81 Å) NiMo catalyst, some post reactor plugging was observed. Examination of the product revealed the presence of solids in a liquid phase. The two-phase product was filtered to remove the solids and to produce a clear liquid. The solid and liquid phases were analyzed separately and the total product composition was calculated from the ratio of solids to liquids. The results are listed in Table 4. Although it was not possible to make complete material balances, the data show that the degree of hydrogenation and denitrogenation on the combined product was comparable to corresponding runs with Blend A over HDS-1441A catalyst (compared with Examples 2 and 8 in Table 3). However, the use of this catalyst and/or the higher concentration of SRC caused an in-situ deasphalting of the product resulting in a lower quality solid phase (i.e., higher nitrogen, lower hydrogen) and a significantly upgraded liquid phase.

The higher concentration SRC Blend B (60%) was then hydroprocessed using a large pore ($\bar{d}$=171 Å) NiMo catalyst. The complete data from this run are given in Tables 5 and 6. The run was on-stream for about seven days with no indication of post-reactor plugging. Inspection of the product showed it to consist of a single liquid phase at room temperature. The degree of hydrogenation and denitrogenation using the large pore NiMo catalyst is comparable to that reported for the small pore NiMo catalyst (compare Examples 14 and 17 in Table 5 with the low and high severity runs listed in Table 4). However, the use of the large pore catalyst has prevented the in-situ separation of the solid residue which occurred with the small pore catalyst.

The use of controlled catalyst pore size and SRC concentration to cause or to prevent in-situ solid separation in the hydroprocessing of SRC is new. Solid separation schemes (e.g., solvent deasphalting) have previously been reported for both coal and petroleum liquids but these processes involve an extraneous solvent to affect deasphalting. Since the amount of recycle solvent available as a by-product is severely limited in the conventional SRC process, the use of solid SRC or highly concentrated blends of SRC/recycle solvent will only be available for eventual hydroprocessing. Our techniques for hydroprocessing concentrated blends of SRC/recycle solvent enable such a blend to be processed so as to yield either one or two phase products. In one case, the total charge is uniformly upgraded; in the other, a significantly upgraded portion (filtrate) and a low sulfur, low ash solid precipitate are obtained.

Table 4

| Severity | Charge | Low Severity Example 11 (1) Liquid | Solid | Total (Calc.) | High Severity Example 12 (2) Liquid | Solid | Total (Calc.) |
|---|---|---|---|---|---|---|---|
| | Hydroprocessing Blend B Over Ketjen 153S Catalyst | | | | | | |
| Wt % Product | | 87 | 13 | (100) | 75 | 25 | (100) |
| Analysis, Wt % | | | | | | | |
| Hydrogen | 6.34 | 9.54 | 8.06 | (9.34) | 10.61 | 9.04 | (10.22) |
| Nitrogen | 1.25 | 0.53 | 1.02 | (0.59) | 0.25 | 0.96 | (0.43) |

(1) 2000 psig $H_2$ pressure, 725° F., 1.0 LHSV.
(2) 2000 psig $H_2$ pressure, 725° F., 0.25 LHSV.

Table 5

| Example No. | Charge | 13 | 14 | 15 | 16 | 17 | 18 |
|---|---|---|---|---|---|---|---|
| Hydroprocessing Blend B Over Harshaw 618X Catalyst: Processing Conditions and Liquid Product Properties | | | | | | | |
| OPERATING CONDITIONS | | Z | | | | | |
| Temperature, °F. | | 672 | 729 | 780 | 673 | 725 | 777 |
| Pressure, PSIG | | 2000 | 2000 | 2000 | 2000 | 2000 | 2000 |
| LHSV | | .84 | .84 | .87 | .20 | .19 | .27 |
| LIQUID PRODUCT PROPERTIES | | | | | | | |
| Gravity, API | −5.3 | 1.2 | 5.2 | 9.2 | 5.9 | 11.8 | 13.6 |
| Hydrogen, Wt. Pct. | 6.36 | 7.70 | 8.63 | 9.26 | 8.95 | 9.90 | 9.79 |
| Sulfur, Wt. Pct. | .47 | .18 | .13 | .06 | .12 | .06 | .04 |
| Nitrogen, Wt. Pct. | 1.25 | .90 | .74 | .25 | .50 | .32 | .28 |
| Oxygen, Wt. Pct. | 4.30 | 2.30 | 1.40 | .70 | 1.20 | .40 | .30 |
| CCR, Wt. Pct. | 24.96 | 17.32 | 12.82 | 10.04 | 11.83 | 8.18 | 6.00 |
| % Aromatic Carbon | 78.00 | 67.00 | 54.00 | 47.00 | — | — | 46.00 |
| HETEROATOM REMOVAL, PCT. | | | | | | | |
| Sulfur | | 61.8 | 73.8 | 86.7 | 74.9 | 87.9 | 91.9 |
| Oxygen | | 47.5 | 68.2 | 84.4 | 72.8 | 91.0 | 93.4 |
| Nitrogen | | 29.3 | 42.2 | 80.8 | 61.0 | 75.3 | 78.8 |
| HYDROGEN UTILIZATION, SCF/BBL | | | | | | | |
| H2 Consumed by C1-C5 | | 44 | 89 | 232 | 96 | 228 | 510 |
| H2 Consumed by C6+ | | 889 | 1545 | 1890 | 1761 | 2378 | 2147 |
| H2 Consumed by S | | 14 | 16 | 19 | 16 | 19 | 20 |
| H2 Consumed by N | | 58 | 84 | 161 | 122 | 150 | 157 |
| H2 Consumed by O | | 190 | 273 | 338 | 292 | 365 | 374 |
| H2 Consumed Total | | 1195 | 2007 | 2640 | 2287 | 3140 | 3209 |

Table 6

| Hydroprocessing Blend B Over Harshaw 618X Catalyst: Processing Conditions and Yields | | | | | | | |
|---|---|---|---|---|---|---|---|
| Example No. | Charge | 19 | 20 | 21 | 22 | 23 | 24 |
| MATERIAL BALANCE, PCT. WT. | | 91.0 | 99.0 | 99.1 | 95.7 | 96.2 | 100.0 |
| OPERATING CONDITIONS | | | | | | | |
| Temperature, °F. | | 672 | 729 | 780 | 673 | 725 | 777 |
| Pressure, PSIG | | 2000 | 2000 | 2000 | 2000 | 2000 | 2000 |
| LHSV | | .84 | .84 | .87 | .20 | .19 | .27 |
| H2 Circulation, SCF/BBL | | 6609 | 7558 | 7395 | 8008 | 8317 | 6488 |
| Days on Stream | | 1.0 | 1.5 | 1.8 | 3.0 | 4.6 | 6.0 |
| YIELDS, Wt. % | | | | | | | |
| C1-C3 | | .16 | .41 | 1.04 | .44 | .96 | 2.52 |
| C4 | | .15 | .22 | .44 | .23 | .50 | .69 |
| C5 | | .05 | .01 | .14 | .03 | .15 | .23 |
| C6+ | 100.00 | 98.20 | 97.76 | 96.21 | 97.57 | 96.63 | 94.72 |
| N2S | | .31 | .37 | .43 | .37 | .44 | .46 |
| NH3 | | .45 | .64 | 1.23 | .93 | 1.14 | 1.20 |
| H20 | | 2.30 | 3.30 | 4.08 | 3.53 | 4.41 | 4.52 |
| DISTILLATION, °F. (D-2887) | | | | | | | |
| IBP | 329 | 204 | 205 | 180 | 175 | 181 | 176 |
| 5 Pct. Vol. | 392 | 359 | 293 | 269 | 281 | 285 | 216 |
| 10 Pct. Vol. | 405 | 388 | 378 | 350 | 373 | 340 | 275 |
| 30 Pct. Vol. | 481 | 462 | 446 | 444 | 448 | 441 | 414 |
| 50 Pct. Vol. | 583 | 550 | 528 | 527 | 525 | 507 | 487 |
| 70 Pct. Vol. | | 761 | 705 | 649 | 667 | 589 | 575 |
| 90 Pct. Vol. | | | | | | | |
| 95 Pct. Vol. | | | | | | | |
| EP | | | | | | | |

We claim:

1. A method for hydroprocessing a blend of solvent refined coal with recycle solvent to yield a liquid fuel product of reduced sulfur, nitrogen and oxygen content and enhanced hydrogen to carbon ratio and a solid fuel of low ash and low sulfur content which comprises blending solvent refined coal with a quantity of recycle solvent less than the quantity of solvent refined coal, contacting hydrogen with the blend of solvent refined coal and a quantity of recycle solvent less than the quantity of said solvent refined coal and with a porous catalyst of hydrogenation metals on a porous support wherein the major portion of the pore volume of said catalyst is constituted by pores of less than 100 Å diameter at a hydroprocessing conditions of 650° F. to 850° F., pressure of at least about 500 psig and space velocity of about 0.1 to 3 LHSV and separately recovering from said contacting a hydrotreated liquid product of reduced sulfur, nitrogen and oxygen content and enhanced hydrogen to carbon ratio and a solid fuel of low ash and low sulfur content.

2. A process according to claim 1 wherein the major portion of the pore volume of said catalyst is constituted by pores in the 50–100 Å diameter range.

3. A process according to claim 1 wherein said hydrogenation metals are cobalt-molybdenum.

4. A process according to claim 1 wherein said hydrogenation metals are nickel-molybdenum.

* * * * *

UNITED STATES PATENT AND TRADEMARK OFFICE

CERTIFICATE OF CORRECTION

PATENT NO. : 4,200,521

DATED : April 29, 1980

INVENTOR(S) : Thomas R. Stein, Roland H. Heck, Michael J. Dabkowski

It is certified that error appears in the above-identified patent and that said Letters Patent are hereby corrected as shown below:

Col. 3, line 1 "basis" should read as -- basic -- ;

Col. 3, line 7 "were" should read as -- was -- ;

Col. 3, line 21 "as" should read as -- at -- ;

Col. 4, line 44 "of" should read as -- to -- ;

Col. 5, line 59 "16" should read as -- 16 -- ;

Col. 6, line 18 "or" should read as -- of -- ;

Col. 7, line 26 "SRc" should read as -- SRC -- ;

Col. 7, line 39 "____" should read as -- -- -- ;

Col. 8, line 29 " > " should read as -- < -- ;

Col. 10, Table 5, under Example 13 delete the letter Z.

Signed and Sealed this

Seventh Day of October 1980

[SEAL]

Attest:

SIDNEY A. DIAMOND

Attesting Officer

Commissioner of Patents and Trademarks